US008646636B2

(12) United States Patent
Sasaki et al.

(10) Patent No.: US 8,646,636 B2
(45) Date of Patent: Feb. 11, 2014

(54) SYNTHETIC RESIN CONTAINER

(75) Inventors: Masaaki Sasaki, Tokyo (JP); Keiji Shimamoto, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 13/703,807

(22) PCT Filed: Jun. 30, 2011

(86) PCT No.: PCT/JP2011/003758

§ 371 (c)(1),
(2), (4) Date: Feb. 1, 2013

(87) PCT Pub. No.: WO2012/001985

PCT Pub. Date: Jan. 5, 2012

(65) Prior Publication Data

US 2013/0140261 A1 Jun. 6, 2013

(30) Foreign Application Priority Data

Jun. 30, 2010 (JP) ..... 2010-150358

(51) Int. Cl.
*B65D 90/02* (2006.01)
*B65D 8/12* (2006.01)

(52) U.S. Cl.
USPC ..... 215/382; 215/383; 220/675

(58) Field of Classification Search
USPC ..... 215/40, 382, 381; D9/559, 566, 568; 220/675
See application file for complete search history.

(56) References Cited

U.S. PATENT DOCUMENTS 5,499,730 A * 3/1996 Harbour ..... 215/382
5,642,826 A * 7/1997 Melrose ..... 215/382
D387,279 S * 12/1997 Emre et al. ..... D9/542
D400,105 S * 10/1998 Beechuk et al. ..... D9/531

(Continued)

FOREIGN PATENT DOCUMENTS

JP A-6-127542 5/1994
JP A-2006-315693 11/2006

(Continued)

OTHER PUBLICATIONS

Sep. 13, 2011 International Search Report issued in International Application No. PCT/JP2011/003758 (with translation).

*Primary Examiner* — Mickey Yu
*Assistant Examiner* — Niki Eloshway
(74) *Attorney, Agent, or Firm* — Oliff PLC

(57) ABSTRACT

A novel synthetic resin container includes an entirely or partly dome-like shoulder portion interconnecting a mouth portion and an upper end of a body portion, and provides high strength at the shoulder portion and excellent aesthetic appearance. The shoulder portion has a dome-like region with a plurality of rhombic and triangular bulging portions arranged in the circumferential direction, each protruding outward from its rhombic or triangular outer edge toward its inner edge. The plurality of triangular bulging portions are arranged between the rhombic portions. The rhombic inner edge defines a region protruding inward of the container and thereby forming a rhombic depression, which is provided with a rib having a vertical contour line that protrudes outward. The triangular inner edge defines a region protruding inward of the container so as to form a triangular depression, which is provided with a rib having a vertical contour line that protrudes outward.

16 Claims, 5 Drawing Sheets

(56) References Cited

U.S. PATENT DOCUMENTS

| | | | | |
|---|---|---|---|---|
| D595,590 | S * | 7/2009 | Lablaine | D9/651 |
| 7,556,164 | B2 * | 7/2009 | Tanaka et al. | 215/373 |
| 8,162,162 | B2 * | 4/2012 | Hata et al. | 215/382 |
| 2004/0134872 | A1 | 7/2004 | Sasaki et al. | |
| 2005/0139572 | A1 * | 6/2005 | Pedmo et al. | 215/381 |
| 2009/0065468 | A1 | 3/2009 | Hata et al. | |
| 2011/0198310 | A1 * | 8/2011 | Deitelbaum et al. | 215/12.1 |

FOREIGN PATENT DOCUMENTS

| | | |
|---|---|---|
| JP | A-2008-247430 | 10/2008 |
| JP | A-2009-241940 | 10/2009 |
| WO | WO 02/081313 A1 | 10/2002 |

* cited by examiner

SYNTHETIC RESIN CONTAINER

TECHNICAL FIELD

The present invention relates to a synthetic resin container.

BACKGROUND ART

There is known a conventional synthetic resin container that has a shoulder portion interconnecting the root of a mouth portion and the upper end of a body portion, wherein the shoulder portion entirely or partly constitutes a dome-like region which is gradually curved and enlarged outward of the container while extending from the root of the mouth portion toward the body portion (refer, for example, to WO 02081313 A1 (PTL 1)).

CITATION LIST

Patent Literature

PTL 1: WO 02081313 A1

SUMMARY OF INVENTION

Technical Problem

However, such a synthetic resin container had a drawback in that, due to change (decrease) of inner pressure during the process of hot filling (filling, cooling) of the content liquid, the dome-like region could be deformed into a polygonal sectional shape such as a triangular sectional shape in the radial section of the container. It is contemplated that this phenomenon is associated with the circumferential strength (the strength around the container axis) and the radial strength (the strength in the container widthwise direction) of the dome-like region. In this respect, there is a room for further improvement in external appearance of the dome-like region.

It is an object of the present invention to provide a novel synthetic resin container that has a shoulder portion which is entirely or partly formed with a dome-like shape, having high strength at the shoulder portion, and exhibiting excellent aesthetic appearance.

Solution to Problem

A synthetic resin container according to the present invention comprises a body portion, a mouth portion, and a shoulder portion interconnecting a root of the mouth portion and an upper end of the body portion, the shoulder portion entirely or partly having a dome-like region formed with a dome-like contour, wherein:

the dome-like region is provided with a plurality of rhombic bulging portions arranged in a circumferential direction, the rhombic bulging portions each has a rhombic outer edge having a rhombic shape and a rhombic inner edge being surrounded by the rhombic outer edge and having a rhombic shape smaller than the rhombic outer edge, and protrudes outward of the container from the rhombic outer edge toward the rhombic inner edge, the rhombic inner edge defining a region protruding inward of the container and thereby forming a rhombic depression, and the depression is provided with a rib having a vertical contour line that protrudes outward.

Advantageous Effect of Invention

According to the present invention, a plurality of rhombic bulging portions are serially arranged in the circumferential direction of the dome-like region, the rhombic bulging portions each protrudes outward of the container from the rhombic outer edge toward the rhombic inner edge, and the rhombic inner edge of the rhombic bulging portion defines a region that protrudes inward of the container so as to form a depression. Thus, for example, it is possible to simultaneously improve the strength of the dome-like region in different surface directions, for example, the strength in the direction of the contour line defining the side shape (longitudinal sectional shape) of the dome-like region; and the circumferential strength (the strength around the container axis) and the radial strength (the strength in the direction extending perpendicular to the container axis and radially toward the axis) along the planar shape (cross sectional shape) of the dome-like region.

With such a structure, since the overall strength of the dome-like regions is improved, even if, for example, the inner pressure of the container decreases due to pressure reduction upon hot filling, it is possible to suppress undesirable deformation of the shoulder portion in the radial section. Also, even if a large load is exerted in the direction of the container axis, it is possible to suppress buckling in the direction of the container axis, thereby effectively maintaining the external shape.

According to the present invention, since the depression of the rhombic bulging portion is provided with a rib having a vertical contour (the contour line as seen in a side view of the dome-like region) that protrudes outward of the container, it is possible to ensure that the three dimensional shape of the dome-like region, at portions where the ribs are formed, has a contour rather close to a dome-like shape, similarly to the conventional art, while effectively improving the strength against buckling.

Therefore, according to the present invention, it is possible to provide a novel synthetic resin container that has a shoulder portion, which is entirely or partly formed with a dome-like shape, has high strength at the shoulder portion, and has an excellent aesthetic appearance.

In the present invention, the following structural measures may be adopted:

- triangular bulging portions are provided between the rhombic bulging portions on the side of at least one of the mouth portion and body portion, the rhombic bulging portions being arranged in the circumferential direction;
- the triangular bulging portions each has a triangular outer edge having a triangular shape and a triangular inner edge being surrounded by the triangular outer edge and having a triangular shape smaller than the triangular outer edge;
- the triangular bulging portions each protrudes outward of the container from the triangular outer edge toward the triangular inner edge;
- the triangular inner edge defines a region protruding inward of the container, so as form a depression; and
- the depression is formed with a rib having a vertical contour line that protrudes outward.

With these structural measures, the effect which is similar to the effect provided by the aforementioned rhombic bulging portions is additionally provided, and it is thereby possible to further effectively improve the strength and aesthetic appearance at the shoulder portion.

In the present invention, an even number of the rhombic bulging portions may be arranged in the circumferential direction of the dome-like region. In such a structure, an even number of the triangular bulging portions may also be arranged in the circumferential direction.

In a case where an even number of the rhombic bulging portions are arranged in the circumferential direction of the dome-like region, the rhombic bulging portions are positioned symmetrically with respect to the container axis. Accordingly, it is possible to improve the strength of the shoulder portion evenly on opposite sides with respect to the container axis. Further, since this symmetric shape is seen as the external shape and accentuates the dome-like contour in the three dimensional contour of the shoulder portion, it is possible to effectively improve the aesthetic appearance of the container.

In the present invention, it is preferable that the contour line of the rib matches with the contour line of the dome-like region. The contour line of the rib, at its intermediate portion in the vertical direction, may be formed with a concave portion, the concave portion protruding inward of the container.

BRIEF DESCRIPTION OF DRAWINGS

The present invention will be further described below with reference to the accompanying drawings, wherein.

DESCRIPTION OF EMBODIMENTS

A bottle 1 according to an embodiment of the present invention will be explained herein below in detail with reference to the drawings.

The bottle 1 is a blow-mold product formed by blow molding a preform made from, for example, PET (polyethylene terephthalate).

A mouth portion 2 has a mouth tube portion 2*a* formed with thread portions 2*s* for attaching a cap (not shown) thereon. The mouth tube portion 2*a* is integrally connected with a root portion 2*b* via a neck ring 2*r*.

The root portion 2*b* of the mouth portion 2 is integrally connected with a shoulder portion 3. The shoulder portion 3 has a dome-like region S, which is gradually curved and enlarged outward of the bottle (radially outward) while extending from the root portion 2*b* toward a body portion 5.

Figure 1:
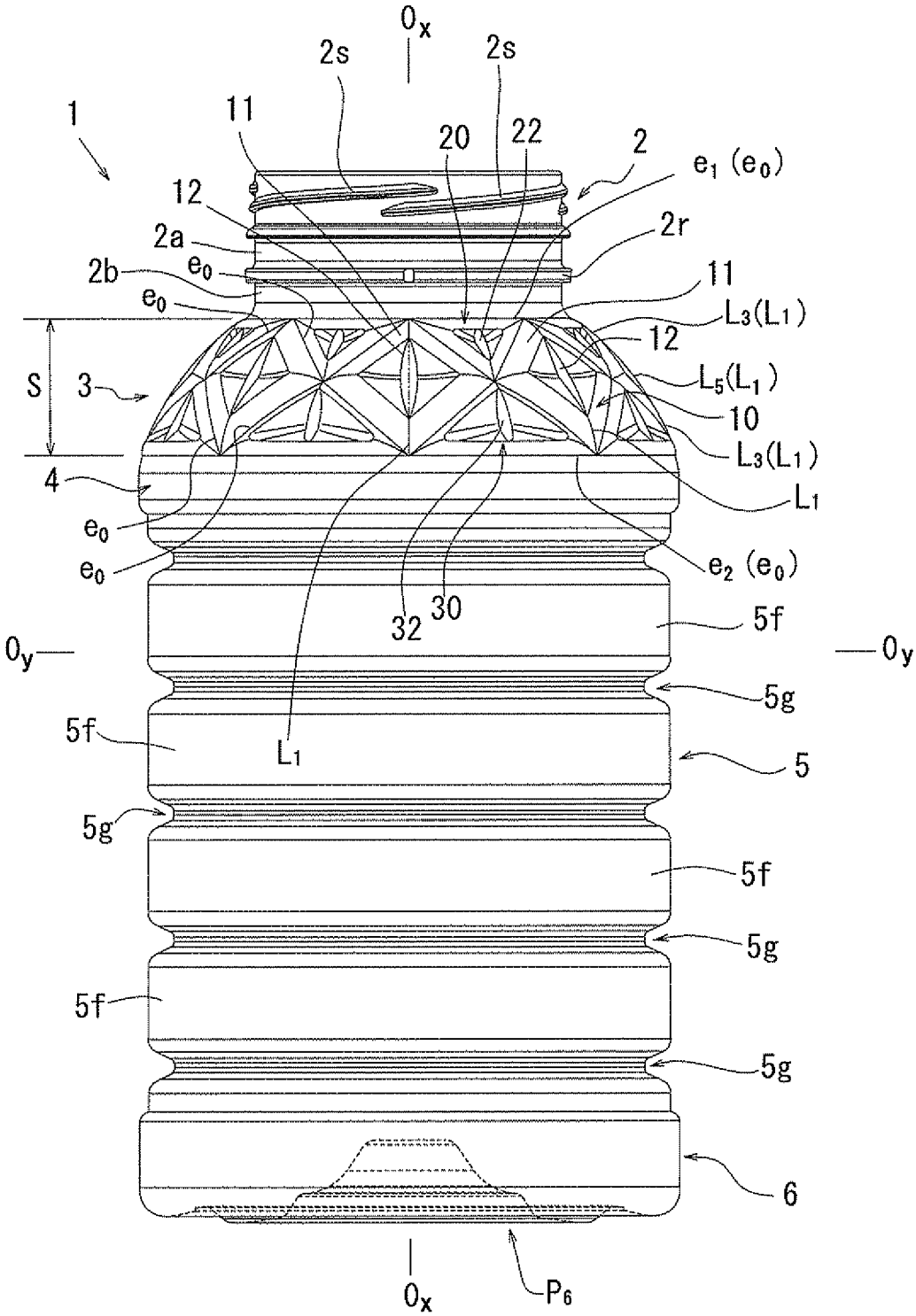
FIG. 1 is a side view showing a bottle according to an embodiment of the present invention.
Figure 2:
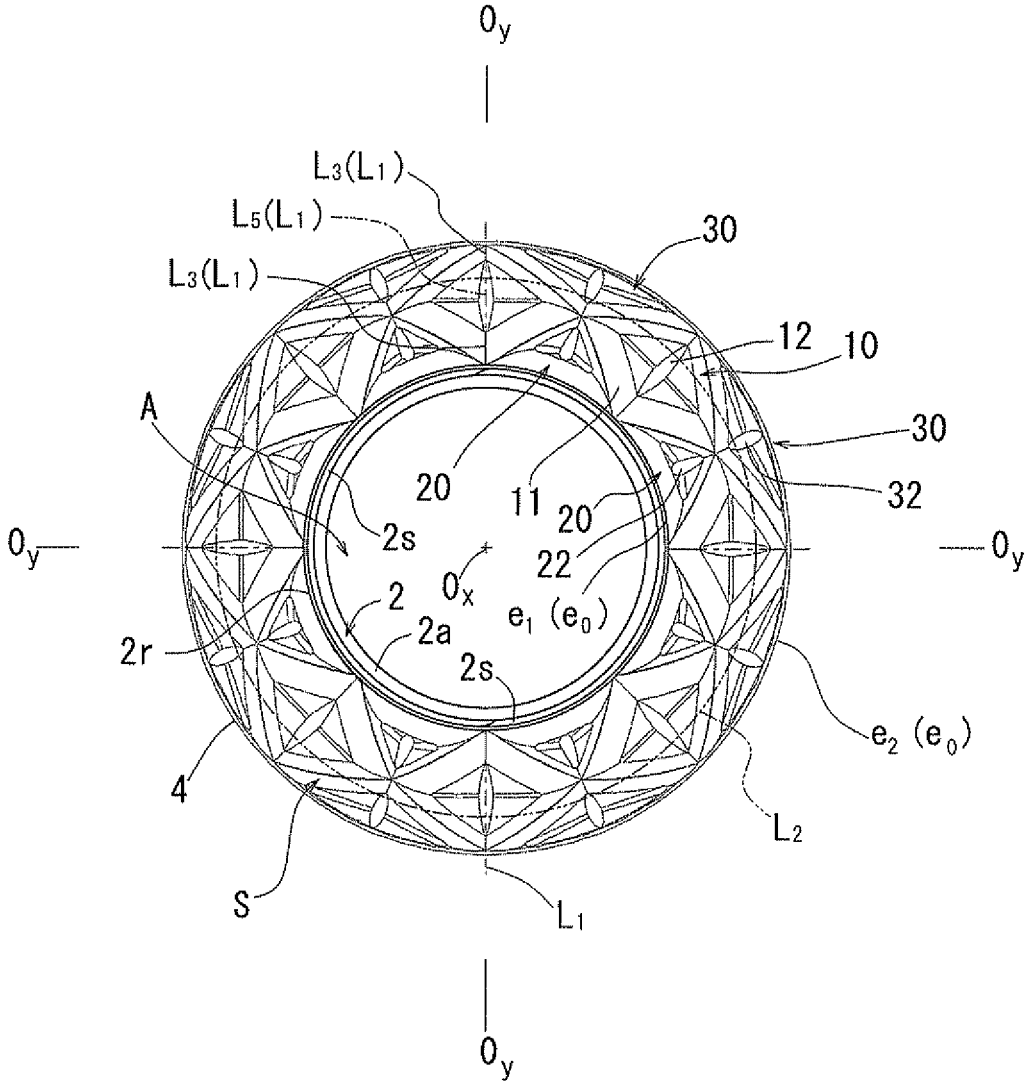
FIG. 2 is a top view showing the embodiment of FIG. 1.
Figure 3:
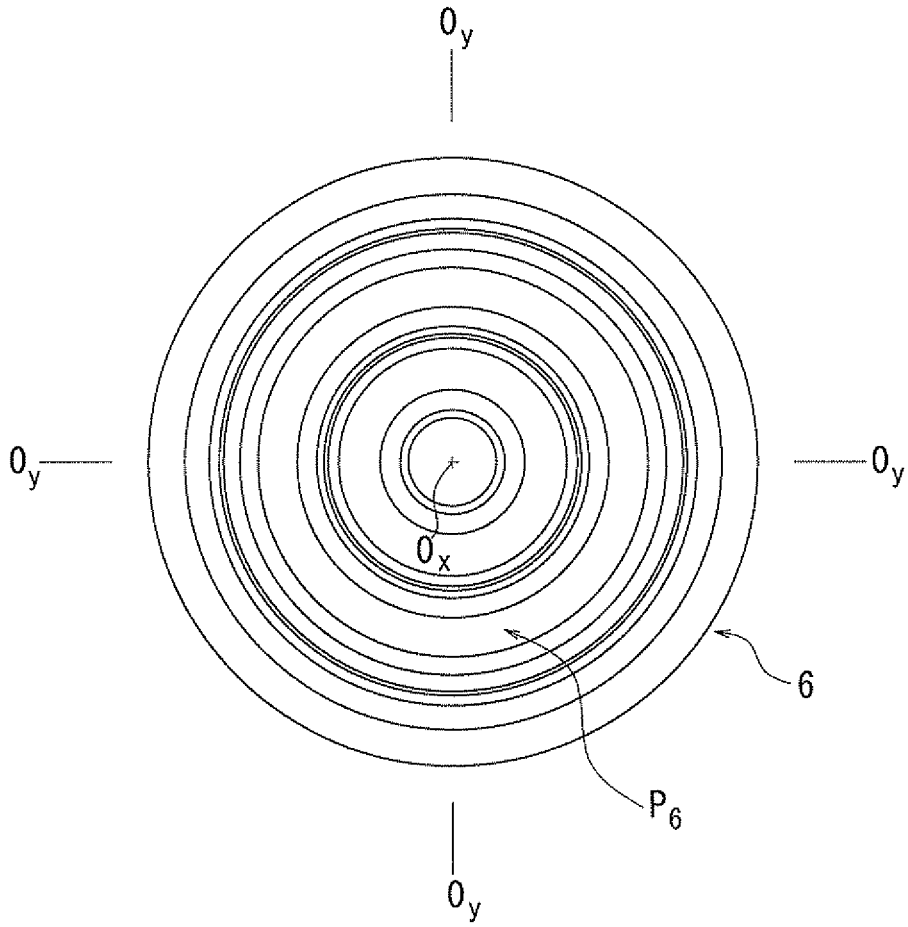
FIG. 3 is a bottom view showing the embodiment of FIG. 1.
Figure 4A:
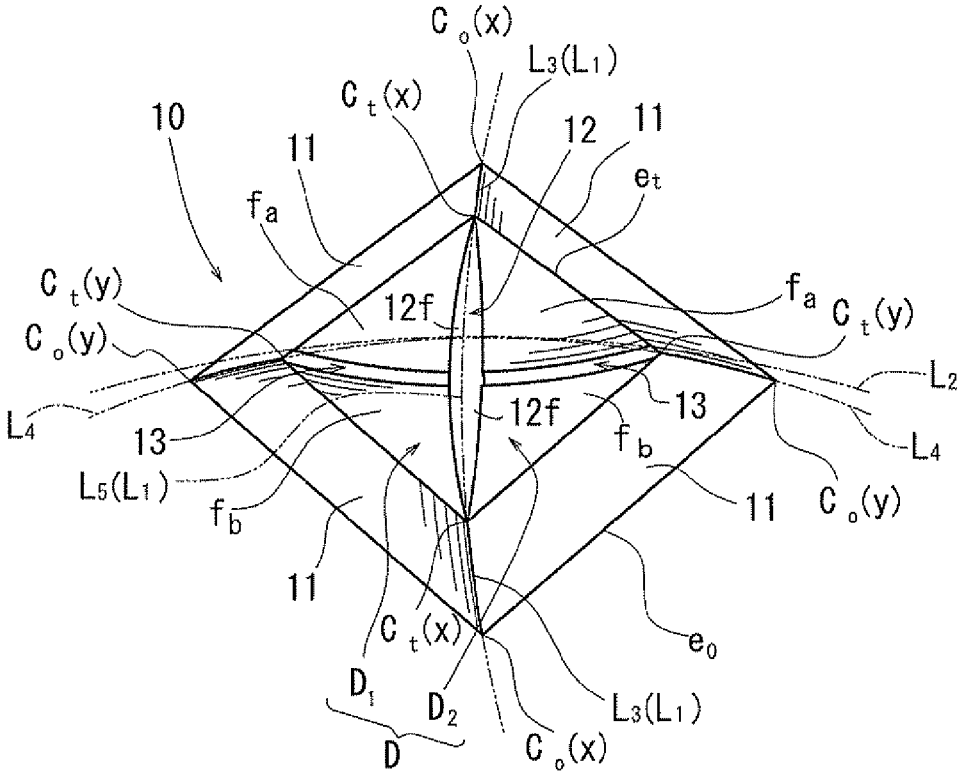
FIGS. 4A and 4B are partial perspective views schematically showing a rhombic bulging portion and a triangular bulging portion according to the embodiment of FIG. 1, respectively.

The dome-like region S, as shown in FIG. 1, is disposed within an annular region defined by a mouth-portion-side end edge $e_1$ encircling the root portion 2*b* and centering around a bottle axis $O_x$ and by a body-portion-side end edge $e_2$ disposed below the mouth-portion-side end edge $e_1$ and encircling the bottle axis $O_x$. The dome-like region S is a region in which a virtual dome-like shape defined by a longitudinal sectional contour line $L_1$ and a cross sectional contour line $L_2$ is embodied. As shown in FIG. 1, the longitudinal sectional contour line $L_1$ extends vertically in the direction of the axis $O_x$ while being curved outward of the bottle, and defines the side shape (longitudinal sectional contour shape) of the dome-like region S. As shown in FIG. 4A, the cross sectional contour line $L_2$ extends in the circumferential direction of the bottle while being curved outward of the bottle around the bottle axis $O_x$, and defines the planar shape (cross sectional contour shape) of the dome-like region S.

The dome-like region S, as shown in FIG. 4A, is integrally provided with a plurality of rhombic bulging portions 10, which protrude outward and are arranged in the circumferential direction around the bottle axis $O_x$ so as to be adjacent to each other. The rhombic bulging portions 10 each has a rhombic shape that is line-symmetric with respect to a central axis $L_3$, which is the longitudinal sectional contour line $L_1$ of the dome-like region S.

Specifically, the rhombic bulging portion 10 has a rhombic outer edge $e_o$ having a rhombic shape for defining the border of the rhombic bulging portion 10, and a rhombic inner edge $e_t$ being surrounded by the rhombic outer edge $e_o$ and having a rhombic shape smaller than the rhombic outer edge $e_o$. The rhombic inner edge $e_t$ comprises: two corner portions $C_t(x)$ facing each other in the vertical direction along the longitudinal sectional contour line $L_1$; and two corner portions $C_t(y)$ facing each other in the horizontal direction along the cross sectional contour line $L_2$. Similarly, the rhombic outer edge $e_o$ comprises: two corner portions $C_o(x)$ facing each other in the vertical direction along the longitudinal sectional contour line $L_1$; and two corner portions $C_o(y)$ facing each other in the horizontal direction along the cross sectional contour line $L_2$.

More specifically, the rhombic bulging portion 10 protrudes outward of the container from the rhombic outer edge $e_o$ toward the rhombic inner edge $e_t$, such that the rhombic inner edge $e_t$ serves as a ridge (tip edge) and that the region between the rhombic inner edge $e_t$ and the rhombic outer edge $e_o$ is edged in a rhombic shape with inclined walls 11. The inclined walls 11 each, for example, is gradually curved outward of the bottle while extending toward the rhombic inner edge $e_t$ so as to protrude outward of the bottle. Particularly, the central axis $L_3$ along the longitudinal sectional contour line $L_1$, as shown in FIG. 4A, constitutes a longitudinal sectional contour line of the inclined walls 11 passing through the corner portions $C_o(X)$ of the rhombic outer edge $e_o$ and the corner portions $C_t(X)$ of the rhombic inner edge $e_t$ and matches with the longitudinal sectional contour line $L_1$ of the dome-like region S. Accordingly, the central axis $L_3$ is gradually curved outward of the bottle while extending toward the center of the region defined by the rhombic inner edge $e_t$ on its inner side (toward the point of intersection with the cross sectional contour line $L_2$) so as to protrude outward of the bottle. In other words, the central axis $L_3$ serves as the longitudinal sectional contour line $L_1$ passing through the corner portions $C_o(x)$ of the rhombic outer edge $e_o$ and the corner portions $C_t(x)$ of the rhombic inner edge $e_t$ and defining the longitudinal sectional contour shape of the rhombic bulging portion 10.

The cross sectional contour line $L_2$ passes through the corner portions $C_t(y)$ of the rhombic inner edge $e_t$. It is preferable that a central axis $L_4$, which passes through the corner portions $C_t(y)$ of the rhombic inner edge $e_t$ and the corner portions $C_o(y)$ of the rhombic outer edge $e_o$ and constitutes a cross sectional contour line of the inclined walls 11, as shown in FIG. 4A, is gradually curved outward of the bottle while extending toward the center of the region defined by the rhombic inner edge $e_t$ on its inner side (toward the longitudinal sectional contour line $L_1$) so as to protrude outward of the bottle. However, in the present invention, the inclined walls 11 each may have a flat face, rather than the curved face as in the present embodiment.

The region defined by the rhombic inner edge $e_t$ on its inner side, as shown in FIG. 4A, is formed as a depression D that is gradually depressed inward of the bottle while extending toward the center of the region. In other words, the region defined by the rhombic inner edge $e_t$ protrudes inward of the bottle 1 so as to be formed as the depression D having a rhombic shape.

The depression D, as shown in FIG. 4A, is formed with a rib 12, which is disposed between the corner portions $C_t(x)$ of the rhombic inner edge $e_t$ and extends across the depression D. A longitudinal sectional contour line $L_5$ defining the side shape (longitudinal sectional contour shape) of the rib 12, as shown in FIG. 1, matches with the longitudinal sectional contour line $L_1$ of the dome-like region S which protrudes outward of the bottle 1 so as to be curved outward of the bottle 1. Accordingly, the inclined walls 11 and the rib 12 of the rhombic bulging portion 10 form a continuous curved line $L_3$, $L_5$ across the entire height range of the dome-like region S. As shown in FIG. 1, the continuous curved line matches with the contour line $L_1$ of the dome-like region S.

The rib 12, as shown in FIG. 4A, divides the depression D into two regions $D_1$, $D_2$. Each of the regions $D_1$, $D_2$, as shown in FIG. 4A, is formed with a bottom groove 13 which extends from the corner portion $C_t(y)$ of the rhombic inner edge $e_t$ and reaches the side face 12*f* of the rib 12. The bottom grooves 13 divide the respective regions $D_1$, $D_2$ into curved faces $f_a$, $f_b$. Although the curved faces $f_a$, $f_b$ are curved inward of the bottle, in the present invention they may be replaced by flat faces (inclined faces). Although the bottom grooves 13 each is curved inward of the bottle, it may be replaced by a ridge. Alternatively, the curved faces $f_a$, $f_b$ may form a continuous curved face, without the bottom groove being formed.

Figure 4B:
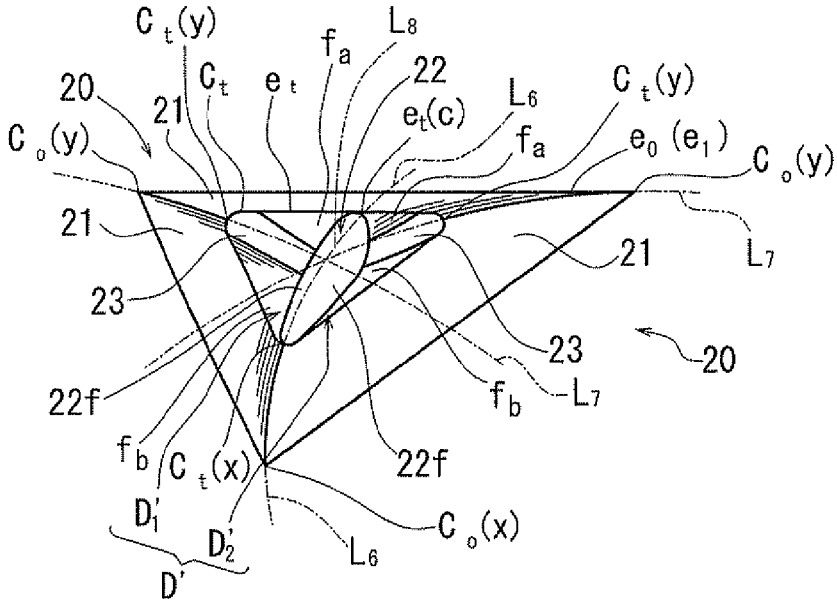

As shown in FIG. 1, a plurality of triangular bulging portions 20 and 30 are disposed between the rhombic bulging portions 10 on the side of the mouth portion 2 and of the body portion 5, respectively. The triangular bulging portions 20 and 30 protrude outward and are arranged around the bottle axis $O_x$ so as to be adjacent to each other. As illustrated in FIG. 4B, the triangular bulging portions 20 each has a triangular shape that is line-symmetric with respect to a central axis $L_g$.

With reference to FIG. 4B, the triangular bulging portions 20 formed on the side of the mouth portion 2, each has a triangular outer edge $e_o$ having a triangular shape and defining the border of the triangular bulging portion 20, and a triangular inner edge $e_t$ having a triangular shape that is surrounded by the triangular outer edge $e_o$ and is smaller than the triangular outer edge $e_o$. The triangular inner edge $e_t$ comprises: one corner portion $C_t(x)$ located on a central axis $L_6$ extending vertically along the outer surface of the container; and two corner portions $C_t(y)$ facing each other in the horizontal direction along the circumferential direction perpendicular to the central axis $L_6$. The corner portion $C_t(x)$ and corner portions $C_t(y)$ are positioned so as to face respective opposite sides of the triangle. Preferably, at least one of the corner portion Ct(x) and corner portions Ct(y) is positioned on a central axis of the respective opposite side of the triangle, such that the shape of the triangle becomes an isosceles triangle or equilateral triangle.

Similarly, the triangular outer edge $e_o$ comprises: one corner portion $C_o(x)$ located on the central axis $L_6$; and two corner portions $C_o(y)$ facing each other in the horizontal direction along the circumferential direction perpendicular to the central axis $L_6$. The corner portion $C_o(x)$ and corner portions $C_o(y)$ are positioned so as to face respective opposite sides of the triangle. At least one of the corner portion $C_o(x)$ and corner portions $C_o(y)$ is positioned on a central axis of the respective opposite side of the triangle, such that the shape of the triangle becomes an isosceles triangle or equilateral triangle.

In the present embodiment, one vertex of the triangular bulging portion 20 located on the mouth-portion side is opposed to one vertex of the triangular bulging portion 30 located on the body-portion side in the direction of the longitudinal sectional contour line $L_1$ and is connected to the one vertex of the triangular bulging portion 30. The triangular bulging portions 20 on the mouth-portion side and the triangular bulging portions 30 on the body-portion side both have the shape of an isosceles triangle. In this case, these isosceles triangles may be geometrically similar to each other. Particularly, in the present embodiment, the central axis $L_6$ passing through the corner portion $C_t(x)$ and corner portion $C_o(x)$ is parallel to the longitudinal sectional contour line $L_t$.

More specifically, the triangular bulging portion 20 protrudes outward of the container from the triangular outer edge $e_o$ toward the triangular inner edge $e_t$, such that the triangular inner edge $e_t$ serves as a ridge (tip edge) and that the region between the triangular inner edge $e_t$ and the triangular outer edge $e_o$ is edged in a triangular shape with inclined walls 21. The inclined walls 21 each, for example, is gradually curved outward of the bottle while extending toward the triangular inner edge $e_t$ so as to protrude outward of the bottle. Particularly, the central axis $L_6$, as shown in FIG. 4B, is gradually curved outward of the bottle while extending toward the center of the region defined by the triangular inner edge $e_t$ on its inner side so as to protrude outward of the bottle.

It is preferable that the shape of the triangular bulging portion 20 at the inclined walls 21 along the circumferential direction is gradually curved outward of the bottle while extending toward the center of the region defined by the triangular inner edge $e_t$ on its inner side so as to protrude outward of the bottle. The inclined walls 21 each may have a flat face, rather than the curved face as in the present embodiment.

The region defined by the triangular inner edge $e_t$ on its inner side, as shown in FIG. 4B, is formed as a depression D' that is gradually depressed inward of the bottle while extending toward the center of the region. In other words, the region defined by the triangular inner edge $e_t$ protrudes inward of the bottle 1 so as to be formed as the depression D' having a triangular shape.

The depression D', as shown in FIG. 4B, is formed with a rib 22, which is disposed between the corner portion $C_t(x)$ of the triangular inner edge $e_t$ and the central position $e_t(c)$ of the tip edge $e_t$ facing each other along the central axis $L_6$ and extends across the depression D'. The longitudinal sectional contour line $L_8$ defining the side shape (longitudinal sectional shape) of the rib 22 is curved outward of the bottle 1 so as to protrude outward of the bottle 1. Accordingly, the inclined faces 21 and the rib 22 of the triangular bulging portion 20, as shown in FIG. 1, form a continuous curved contour line.

The rib 22, as shown in FIG. 4B, divides the depression D' into two regions $D_1'$, $D_2'$. Each of the two regions $D_1'$, $D_2'$, as shown in FIG. 4B, is formed with a bottom groove 23, which extends from the corner portion $C_t(y)$ of the triangular inner edge $e_t$ facing the side face 22*f* of the rib 22 and reaches the side face of the rib 22. The bottom grooves 23 divide the respective regions $D_1'$, $D_2'$ into curved faces $f_a$, $f_b$. The curved faces $f_a$, $f_b$ are curved inward of the bottle. However, in the present invention, they may be replaced by flat faces (inclined faces). Similarly to the bottom grooves 13, although the bottom grooves 23 each is curved inward of the bottle, it may be replaced by a ridge. Alternatively, the curved faces $f_a$, $f_b$ may form a continuous curved face, without the bottom groove being formed.

The triangular bulging portions 30 formed on the side of the body portion 5 have a triangular shape which is obtained by turning the aforementioned triangular bulging portions 20 up-side down. For this reason, the description on the triangular bulging portions 30 is the same as the foregoing description on the triangular bulging portions 20 with the above exception being made.

In the present invention, the triangular bulging portions (20, 30) may be provided between the rhombic bulging portions 10 on the side of at least one of the mouth portion 2 and body portion 5. For example, the present invention may comprise the combination of the rhombic bulging portions 10 and the triangular bulging portions 20 provided on the side of the mouth portion 2, or the combination of the rhombic bulging portions 10 and the triangular bulging portions 30 provided on the side of the body portion 5, or the present invention may comprise only the rhombic bulging portions 10.

In a case where the triangular bulging portions 20, 30 are provided, it is preferable that the triangular outer edges $e_o$ of the triangular bulging portions 20, 30 and the rhombic outer edges $e_o$ of the rhombic bulging portions 10 constitute common outer edges $e_o$ as in the present embodiment. Further, it is preferable that both ends of the rhombic bulging portions 10 in the circumferential direction are connected to adjacent rhombic bulging portions 10.

The dome-like region S, as shown in FIG. 1, is integrally connected with the body portion 5 via a largest outer diameter portion 4 which protrudes annularly. The body portion 5 is formed with a cylindrical shape and is provided with a plurality of annular concave portions 5*g*. At a bottom portion 6 connected to the bottom end of the body portion 5, a raised-bottom portion $P_6$ bulges. After the mouth portion 2 is sealed and then the inner pressure of the bottle 1 decreases, the raised-bottom portion $P_6$ is pushed upward into the inner side of the body portion 5 according to the amount of decrease of the inner pressure. Accordingly, the raised-bottom portion $P_6$ serves as a pressure-reduction absorbing panel.

According to the present invention, a plurality of rhombic bulging portions 10 are serially arranged in the circumferential direction of the dome-like region S, the rhombic bulging portions 10 each protrudes outward of the container from the rhombic outer edge $e_o$ toward the rhombic inner edge $e_t$, and the region defined by the rhombic inner edge $e_t$ of the rhombic bulging portion 10 protrudes inward of the container so as to form a depression D. Accordingly, for example, it is possible to improve the strength of the dome-like region S in the surface direction (for example, the strength in the direction of the longitudinal sectional contour line $L_1$; and the circumferential strength (the strength around the bottle axis $O_x$ (the strength along the cross sectional contour line $L_2$)) and the radial strength (the strength in the direction extending perpendicular to the bottle axis O, and radially toward the axis $O_x$) (the strength in the widthwise direction $O_y$) along the planar shape (cross sectional shape) of the dome-like region S).

According to such a structure, the overall strength of the dome-like regions S is improved. Therefore, for example, even if the inner pressure of the bottle 1 decreases due to pressure reduction upon hot filling, it is possible to suppress deformation of the shoulder portion 3 in the radial section (for example, undesirable deformation into a triangular sectional shape). Also, even if a large load is exerted in the direction of the bottle axis $O_x$, it is possible to suppress buckling in the direction of the bottle axis $O_x$. Therefore it is possible to effectively maintain the external shape.

According to the present embodiment, the depression D of the rhombic bulging portion 10 is provided with the rib 12 in such a way that: the longitudinal sectional contour line $L_1$ of the rhombic bulging portion 10 along the vertical direction (the contour line as seen in a side view of the dome-like region S) is gradually curved and enlarged outward of the bottle while extending from the root portion 2*b* of the mouth portion 2 toward the body portion 5 so as to have a curved shape (dome-like shape) that protrudes outward of the bottle. Accordingly, it is possible to ensure that the three dimensional shape of the dome-like region S has a contour rather close to a dome-like shape, similarly to the conventional art, while effectively improving the strength against buckling.

Therefore, according to the present embodiment, it is possible to provide a novel bottle which has a shoulder portion 3 formed with a dome-like shape, has high strength at the shoulder portion 3, and has an excellent aesthetic appearance. In the present invention, the dome-like region S may constitute the entire shoulder portion 3 or a portion of the shoulder portion. For example, with reference to the present embodiment, the shoulder portion 3 may include the largest outer diameter portion 4, or may exclude the largest outer diameter portion 4.

As in the present embodiment, the following structure may be employed: the triangular bulging portions 20 (30) are provided between the rhombic bulging portions 10 on the side of at least one of the mouth portion 2 and body portion 5, the rhombic bulging portions 10 being arranged in the circumferential direction; the triangular bulging portions 20 (30) each has a triangular outer edge $e_o$ having a triangular shape and a triangular inner edge $e_t$ being surrounded by the triangular outer edge $e_o$ and having a triangular shape smaller than the triangular outer edge $e_o$ of the triangular bulging portion 20 (30); the triangular bulging portions 20 (30) each protrudes outward of the container from the triangular outer edge $e_o$ toward the triangular inner edge $e_t$; the region defined by the triangular inner edge $e_t$ protrudes inward of the container, so as to be formed as the depression D'; and the depression D' is formed with a rib 22 (32) extending in the vertical direction and protruding outward. According to this structure, the effect of improving strength against buckling, which is similar to the effect provided by the aforementioned rhombic bulging portions 10, is additionally provided, and thereby it is possible to further effectively improve the strength and aesthetic appearance at the shoulder portion 3.

In a case where an even number of the rhombic bulging portions 10 are arranged in the circumferential direction of the dome-like region S, the rhombic bulging portions 10 are positioned symmetrically with respect to the bottle axis $O_x$. Accordingly, it is possible to improve the strength of the shoulder portion 3 evenly with respect to the bottle axis $O_x$. Further, since this symmetrical shape that is seen as the external shape accentuates the dome-like contour in the three dimensional contour of the shoulder portion 3, it is possible to effectively improve the aesthetic appearance of the bottle 1. In such a structure, an even number of the triangular bulging portions 20 (30) are arranged in the circumferential direction. However, the numbers of the bulging portions 10, 20, 30 may be in the range of 6-12. Preferably, the protruding heights of the bulging portions are in the range of 0.5 mm to 3.0 mm.

Figure 5A:
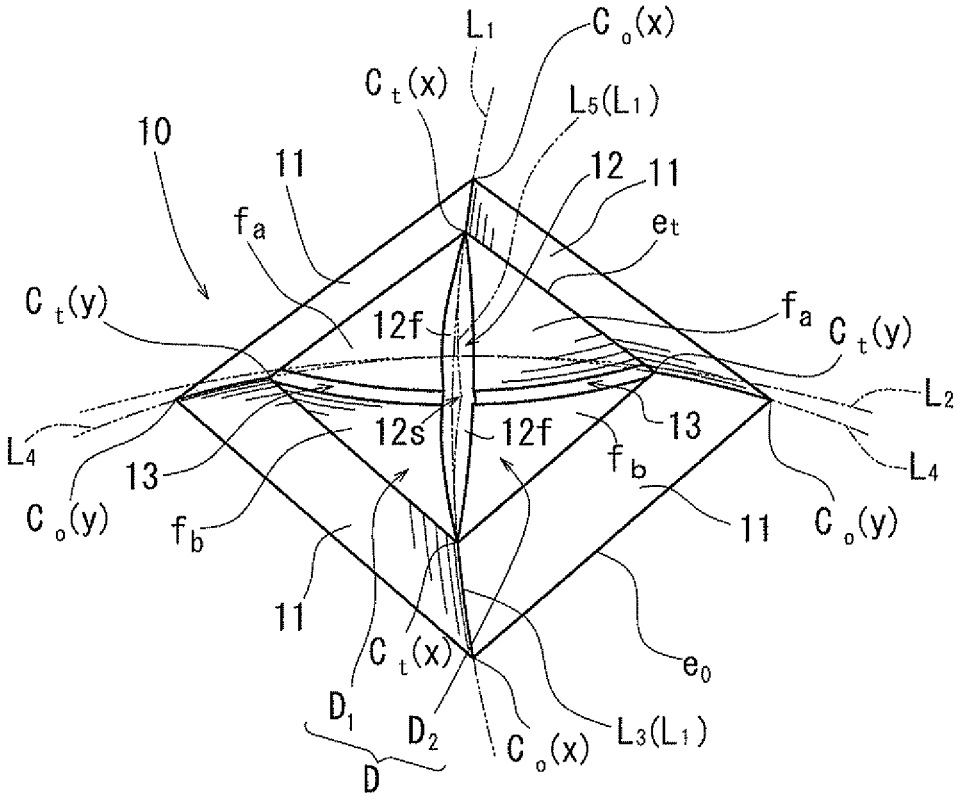
FIGS. 5A and 5B are partial perspective views schematically showing a rhombic bulging portion and a triangular bulging portion according to another embodiment of the present invention, respectively.

In the present invention, it is preferable that, as shown in FIG. 4A, the longitudinal sectional contour line $L_5$ of the rib 12 matches with the longitudinal sectional contour line $L_1$. However, in the present invention, as shown in FIG. 5A, the longitudinal sectional contour line $L_5$ of the rib 12 may protrude inward of the container at its intermediate portion in the vertical direction, so as to form a concave portion 12*s* disposed inward of the longitudinal sectional contour line $L_1$ of the dome-like region S. Also in such a case, it is possible to improve the strength against buckling. Further, it is not necessary that the longitudinal sectional contour line $L_5$ of the rib 12 matches with the longitudinal sectional contour line $L_1$ of the dome-like region S. In other words, the rib may protrude outward of the container from the bottom portion of the depression D of the rhombic bulging portion 10 in an arbitrary manner, however it is preferable that the rib is formed along the longitudinal sectional contour line $L_1$.

Figure 5B:
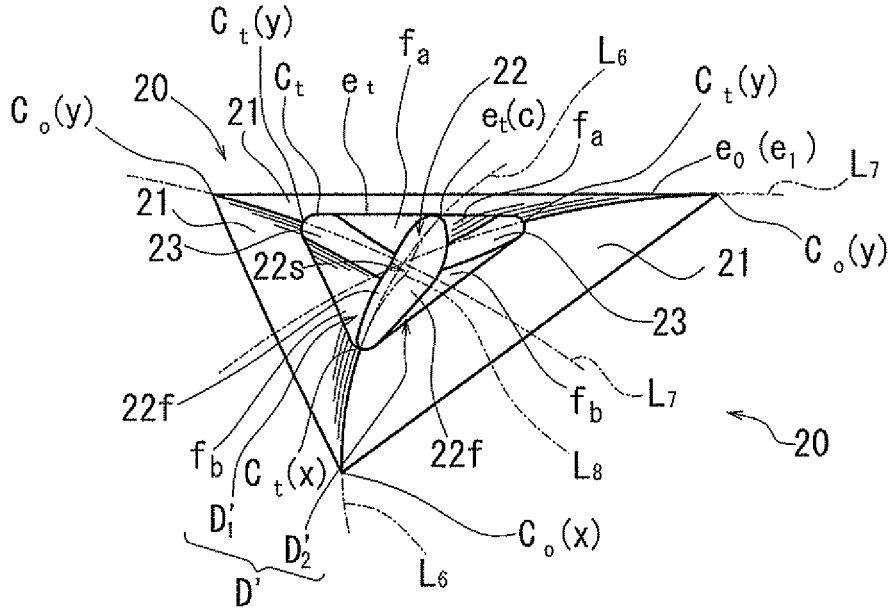

This applies similarly to the triangular bulging portions 20, 30. As shown in FIG. 5B, the intermediate portion of the rib 22 (32) in the vertical direction may protrude inward of the container so as to form a concave portion 22*s* disposed inward of the longitudinal sectional contour line $L_1$. The rib 22 protrudes along the central axis $L_6$ of the triangular bulging portion 20.

Although a preferable embodiment of the present invention has been described above, various modifications may be made within the scope of the invention as defined by the appended claims. For example, the outer edges $e_o$ of the bulging portions 10, 20, 30 may be interconnected at different angles, respectively, or may be arranged in common straight lines, such that the bulging portions 10, 20, 30 are arranged in a grid-like manner.

INDUSTRIAL APPLICABILITY

The present invention can be used as a bottle into which liquid content such as medicines or beverages is filled.

REFERENCE SIGNS LIST

1 PET bottle
2 Mouth portion
2*a* Mouth tube portion
2*b* Root portion
3 Shoulder portion
4 Largest outer diameter portion
5 Body portion
5*f* Cylindrical panel
5*g* Annular concave portion
6 Bottom portion
10 Rhombic bulging portion
11 Inclined wall
12 Rib
13 Bottom groove
20 Triangular bulging portion
21 Inclined wall
22 Rib
23 Bottom groove
30 Triangular bulging portion
31 Inclined wall
32 Rib
33 Bottom groove
D Depression
D' Depression
$e_o$ Outer edge of bulging portion
$e_t$ Tip edge (ridge) of bulging portion
$L_1$ Longitudinal sectional contour line of dome-like region
$L_2$ Cross sectional contour line of dome-like region
$L_3$ Central line
$L_4$ Central line
$L_5$ Longitudinal sectional contour line of rib
$L_6$ Central line
$L_7$ Central line
$L_8$ Contour line of rib
S Dome-like region

The invention claimed is:

1. A synthetic resin container comprising a body portion, a mouth portion, and a shoulder portion interconnecting a root of the mouth portion and an upper end of the body portion, the shoulder portion entirely or partly having a dome-like region with a dome-like contour, wherein:

the dome-like region is provided with a plurality of rhombic bulging portions arranged in a circumferential direction, the rhombic bulging portions each has a rhombic outer edge having a rhombic shape and a rhombic inner edge being surrounded by the rhombic outer edge and having a rhombic shape smaller than the rhombic outer edge, and protrudes outward of the container from the rhombic outer edge toward the rhombic inner edge, the rhombic inner edge defining a region protruding inward of the container and thereby forming a rhombic depression, the depression is provided with a rib having a vertical contour line that protrudes outward, and the rib is disposed between corner portions of the rhombic inner edge and extends across the depression.

2. A synthetic resin container according to claim 1, wherein:

triangular bulging portions are provided between the rhombic bulging portions on the side of at least one of the mouth portion and the body portion, the rhombic bulging portions being arranged in the circumferential direction, the triangular bulging portions each has a triangular outer edge having a triangular shape and a triangular inner edge being surrounded by the triangular outer edge and having a triangular shape smaller than the triangular outer edge, and protrudes outward of the container from the triangular outer edge toward the triangular inner edge, the triangular inner edge defines a region protruding inward of the container so as to form a depression, and the depression is provided with a rib having a vertical contour line that protrudes outward.

3. A synthetic resin container according to claim 2, wherein an even number of the rhombic bulging portions are arranged in the circumferential direction of the dome-like region.

4. A synthetic resin container according to claim 3, wherein the contour line of the rib matches with a contour line of the dome-like region.

5. A synthetic resin container according to claim 4, wherein the contour line of the rib, at its intermediate portion in the vertical direction, is formed with a concave portion protruding inward of the container.

6. A synthetic resin container according to claim 3, wherein the contour line of the rib, at its intermediate portion in the vertical direction, is formed with a concave portion protruding inward of the container.

7. A synthetic resin container according to claim 2, wherein the contour line of the rib matches with a contour line of the dome-like region.

8. A synthetic resin container according to claim 7, wherein the contour line of the rib, at its intermediate portion in the vertical direction, is formed with a concave portion protruding inward of the container.

9. A synthetic resin container according to claim 2, wherein the contour line of the rib, at its intermediate portion in the vertical direction, is formed with a concave portion protruding inward of the container.

10. A synthetic resin container according to claim 1, wherein an even number of the rhombic bulging portions are arranged in the circumferential direction of the dome-like region.

11. A synthetic resin container according to claim 10, wherein the contour line of the rib matches with a contour line of the dome-like region.

12. A synthetic resin container according to claim 11, wherein the contour line of the rib, at its intermediate portion in the vertical direction, is formed with a concave portion protruding inward of the container.

13. A synthetic resin container according to claim 10, wherein the contour line of the rib, at its intermediate portion in the vertical direction, is formed with a concave portion protruding inward of the container.

14. A synthetic resin container according to claim 1, wherein the contour line of the rib matches with a contour line of the dome-like region.

15. A synthetic resin container according to claim 14, wherein the contour line of the rib, at its intermediate portion in the vertical direction, is formed with a concave portion protruding inward of the container.

16. A synthetic resin container according to claim 1, wherein the contour line of the rib, at its intermediate portion in the vertical direction, is formed with a concave portion protruding inward of the container.

* * * * *